United States Patent [19]

Winckler et al.

[11] Patent Number: 4,911,239

[45] Date of Patent: Mar. 27, 1990

[54] METHOD AND APPARATUS FOR REMOVAL OF OIL WELL PARAFFIN

[75] Inventors: Elmer Winckler, Longmont, Colo.; James W. McManus, Dunedin, Fla.

[73] Assignee: Intra-Global Petroleum Reservers, Inc., Sacramento, Calif.

[21] Appl. No.: 183,780

[22] Filed: Apr. 20, 1988

[51] Int. Cl.[4] ..... E21B 36/04

[52] U.S. Cl. ..... 166/302; 166/60; 166/62; 166/65.1; 166/304

[58] Field of Search ..... 166/62, 302, 60, 61, 166/65.1, 248, 68, 241, 304; 175/325; 219/277, 278, 415, 417–419

[56] References Cited

U.S. PATENT DOCUMENTS

| | | | |
|---|---|---|---|
| 712,486 | 11/1902 | Black | 175/325 |
| 712,487 | 11/1902 | Black | 175/325 |
| 806,039 | 11/1905 | Williamson et al. . | |
| 1,383,777 | 7/1921 | Stephens | 166/62 X |
| 1,764,213 | 6/1930 | Knox | 166/62 X |
| 2,244,256 | 6/1941 | Looman | 166/60 |
| 2,561,249 | 7/1951 | Tomlinson | 219/39 |
| 2,598,280 | 5/1952 | McLean | 166/62 X |
| 2,660,249 | 11/1953 | Jakosky | 166/62 X |
| 2,714,930 | 8/1955 | Carpenter | 166/60 |
| 2,728,396 | 12/1955 | Carpenter | 219/277 X |
| 2,781,851 | 2/1957 | Smith | 166/60 |
| 2,812,818 | 11/1957 | Bruses | 166/60 |
| 2,982,354 | 5/1961 | Green | 166/60 |
| 3,207,220 | 9/1965 | Williams | 166/60 |
| 3,213,942 | 10/1965 | Nixon | 166/60 |
| 3,454,094 | 7/1969 | Grolemund et al. | 166/250 |
| 3,507,330 | 12/1970 | Gill | 166/248 |
| 3,547,193 | 12/1970 | Gill | 166/248 |
| 3,605,888 | 9/1971 | Crowson et al. | 166/248 |
| 3,614,986 | 10/1971 | Gill | 166/303 |
| 3,620,300 | 11/1971 | Crowson | 166/248 |
| 3,642,066 | 2/1972 | Gill | 166/248 |
| 4,303,128 | 12/1981 | Marr, Jr. | 166/302 |
| 4,319,632 | 3/1982 | Marr, Jr. | 166/60 |
| 4,538,682 | 9/1985 | McManus et al. | 166/255 |
| 4,576,005 | 3/1986 | Force | 60/618 |
| 4,716,960 | 1/1988 | Eastlund et al. | 166/60 |

FOREIGN PATENT DOCUMENTS 1151531 8/1983 Canada .

*Primary Examiner*—Hoang C. Dang

*Attorney, Agent, or Firm*—Price, Heneveld, Cooper, DeWitt

[57] ABSTRACT

A method and apparatus for reducing the accumulation of paraffin within an oil well that includes forming an electric circuit contact between the oil well sucker rod and tubing and connecting a power source to the sucker rod and tubing. An electric current is applied to the sucker rod in order to generate heat thereat. Preferably a rolling circuit contact is offset from the sucker rod to form a moving contact between the sucker rod and tubing, and in a preferred form a section of the sucker rod and pump is made of a material having a greater electrical resistance to increase the heat generated in a region of high paraffin accumulation. In another embodiment circuit assemblies are provided in the production string to alter the region being heated as the sucker rod reciprocates.

16 Claims, 4 Drawing Sheets

TIMER
CONTROL
POWER SOURCE

METHOD AND APPARATUS FOR REMOVAL OF OIL WELL PARAFFIN

BACKGROUND OF THE INVENTION

The present application relates to oil well servicing and in particular to a method and apparatus for the removal and prevention of paraffin buildup within oil well tubing.

The accumulation of paraffin within the production string of a working oil well is a major problem experienced throughout the oil industry. The paraffin content of crude oil varies greatly between different geographic regions. However, virtually all crude oil contains a sufficient paraffin content that will result in an accumulation of solidified paraffin within the production string of the oil well. The rate of paraffin buildup varies between different wells, but virtually all oil wells experience paraffin accumulation to a degree that requires periodic servicing of the well to remove the paraffin accumulation. If not serviced, the paraffin buildup gradually restricts the oil well output to a very small percentage of its potential output and eventually may shut off oil flow completely.

Heretofore, the servicing of an oil well to remove paraffin accumulation typically required a complete pulling of the production tubing, sucker rod and pump. A transportable workover rig is driven to the well site and used to pull the entire production string section-by-section. New tubing and sucker rod strings are lowered into the well in order to reduce the down time of the well during makeover or servicing. The paraffin restricted sections of tubing and sucker rod are placed in a hot bath in order to melt and remove the paraffin, and then replaced in another oil well. The workover of an oil well is a relatively expensive and time consuming operation, particularly for deep wells having lengthy production strings. Another popular method of removing paraffin is a "hot oil or water treatment". This method involves taking a truck loaded with hot oil or water to the well site and pumping the hot liquid down the anulus and back up the production string, so that the paraffin, which is consequently melted, can be pumped out of the well.

Various attempts have been made to avoid the high cost of working over an oil well by the proposed use of electric heating to reduce paraffin accumulation. In such proposed methods, electrical current is applied to the oil well casing and tubing to result in a heating of those elements. One problem with such systems resides in the fact that the paraffin accumulation occurs within the tubing. Any heating occurring in the casing has a reduced effect on the accumulated paraffin due to the physical separation between casing and tubing and the insulating effect of air or oil therebetween. Another problem associated with such systems are energy losses that occur outwardly from the heated casing into the surrounding earth. It has been found that typical earth formations in the vicinity of oil reserves such as sandstone and the like are relatively good heat conductors. Still another problem resides in the fact that the casing quite often does not extend down the entire length of the well in wells referred to as a "rat hole well". Quite often the casing terminates a substantial distance above the bottom of the well and may be removed from the problematic paraffin accumulation. In all oil wells the well casing must be cemented in. As a result of various problems, such prior casing heating systems have not been accepted in the oil industry.

SUMMARY OF THE INVENTION

The present invention provides a method and apparatus by which an electric current is applied to the sucker rod string of an oil well. An electrical contact between the sucker rod and the tubing is provided in a lower region of the well at or below the paraffin accumulation. As power is applied to the sucker rod, the sucker rod and tubing operate as heating elements, with a greater degree of heating occurring within the sucker rod. The heating system is operated until the paraffin has been melted and pumped out. Periodic operation of the system prevents paraffin accumulation that would otherwise be sufficient to substantially reduce the output of the oil well.

In preferred form, the tubing string is insulated from the casing while the sucker rod string is insulated from the above ground pumping equipment. The circuit contact between the sucker rod and tubing includes at least one rolling contact element, and most preferably a plurality of contacts that are abutted against various radii of the tubing inner wall in order to maintain a solid electrical contact. In certain embodiments sections or segments of the sucker and rod or production string are made from a material having a higher resistance than the remainder of the string, and most preferably stainless steel, in order to increase the amount of heat generated in that region and thereby concentrate more of the heat in high accumulation regions of the well. Near the upper end of the casing, the sucker rod string is insulated from the tubing string with nylon or other non-electrical conducting "rod guides" through which the rod string is centered with respect to the tubing. In an alternative embodiment other heater elements or circuit assemblies are provided in the production string to alter or switch the region or regions being heated as the sucker rod reciprocates. A power source generating different voltages and amperages may also be employed to vary the paraffin melting current as the sucker rod cycles.

With the above system, paraffin accumulation can be prevented or reduced to a level that does not substantially affect the output of the oil well. Due to the efficient use of the operating current by this system, energy requirements for maintaining the system are reduced. After the initial installation of the system, the system obviates the need for a substantial number of workovers or oil/water treatments of the oil well, while substantially constant maintenance of the well's maximum output is provided. These and other benefits, objects and results of the invention will be understood by one skilled in the art from the specification and claims which follow and the drawings appended hereto.

DETAILED DESCRIPTION OF THE PREFERRED EMBODIMENTS

Figures 1, 2, 3:
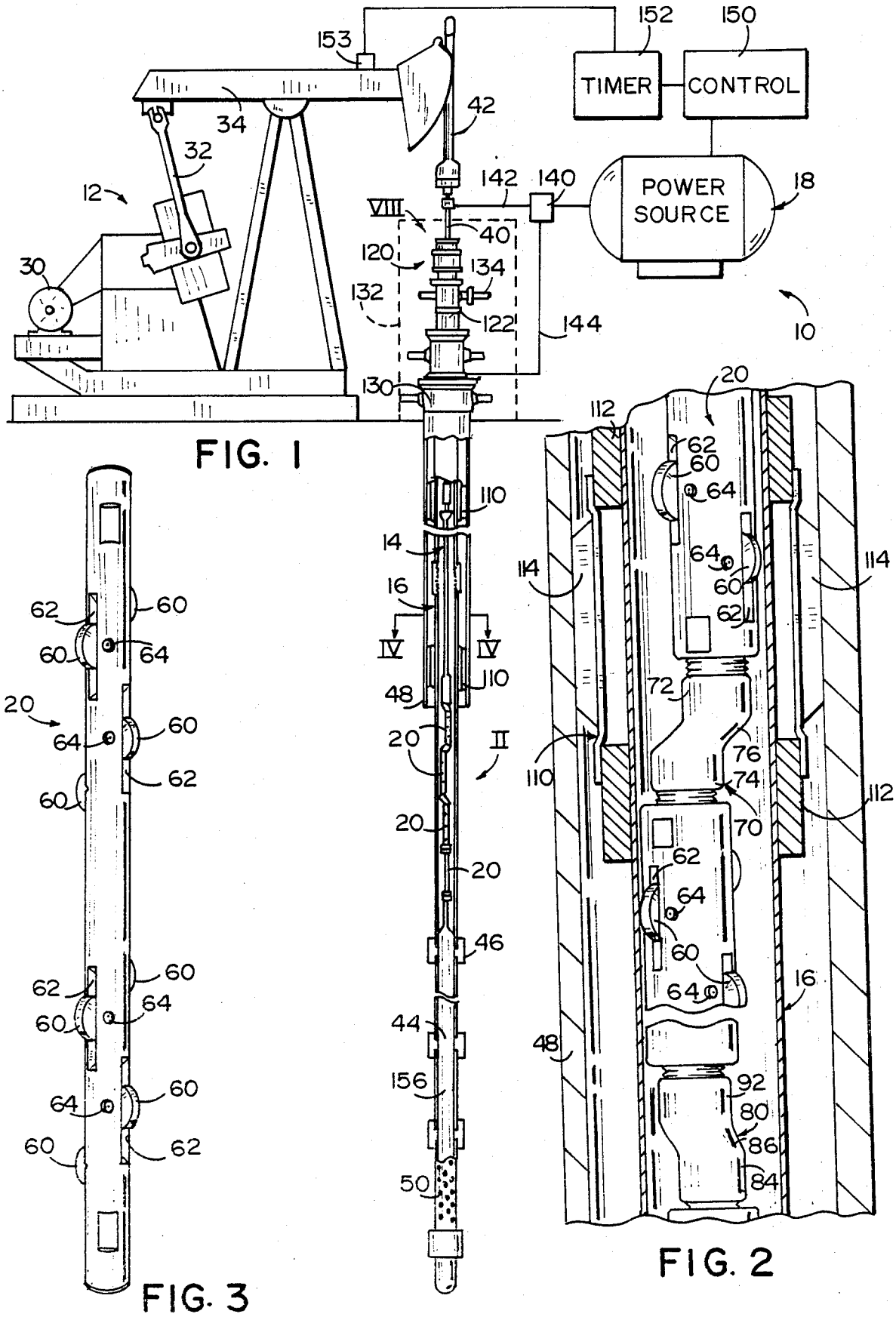
FIG. 1 is a sectional, schematic view of an oil well incorporating a paraffin removal system embodying the present invention.
FIG. 2 is a fragmentary, sectional view of the oil well shown in FIG. 1, taken in the region of Arrow II in FIG. 1.
FIG. 3 is an elevational view of an electrical circuit contact used in the system of FIG. 1.

The present invention is directed to a system used in the removal of accumulated paraffin from an oil well, a preferred embodiment of which is shown in FIG. 1 and referenced generally by the numeral 10. The oil well includes an above ground pumping unit 12 that in operation vertically reciprocates a sucker rod 14. Sucker rod 14 depends into a tubing string 16. A transformer 18 and rectifier provides a power source which is connected to sucker rod 14 and tubing string 16. Coupled in sucker rod 14 are a series of electrical circuit contacts 20. Electrical circuit contacts 20 are offset from the vertical axis of sucker rod 14 and abut the inner surface of tubing string 16, thereby forming a closed electrical circuit between sucker rod 14 and tubing strings 16. Transformer 18 applies a low voltage electrical current to sucker rod 14, causing sucker rod 14 and tubing string 16 to heat due to internal resistance. Current is applied for a period of time sufficient to melt accumulated paraffin within tubing string 16, thereby reducing the occlusion therethrough.

As shown in FIG. 1, pumping unit 12 is of conventional design having a drive motor 30 that reciprocates an eccentric arm 32. Eccentric arm 32 pivots a horse's head or pumping arm 34 that raises and lowers a polished rod 40. Polished rod 40 is suspended from the lifting end of horse's head 34 by a cable line and cable line hanger or bridle 42. Bridle 42 is made with an electrically insulated section to insulate pumping unit 12 from electrically conductive polished rod 40. Any contact surface between horse's head 34 and polished rod 40 is also covered with an electrically insulative material.

Polished rod 40 is secured to the upper end of sucker rod 14. Sucker rod 14 is a series of vertically coupled sections that depend down to a sucker rod pump 44 located at the base of the oil well. Each sucker rod section has a threaded upper male fitting and a threaded lower female fitting to mate with adjacent sucker rod sections. Sucker rod 14 depends roughly concentrically within tubing string 16. Tubing string 16 is similarly constructed from a series of tubing sections coupled by barrel couplings 46. A surface casing 48 extends downwardly concentrically about tubing string 16. Casing 48 may terminate at a distance above the lower end of tubing string 16. A perforated bottom nipple 50 provides a lower opening to tubing 16.

Shown in greater detail in FIGS. 2 and 3 is electrical circuit contact 20. Each circuit contact 20 has an elongated cylindrical shape with an outside diameter ranging preferably between one to two inches, but which is less than the inside diameter of tubing 16. Circuit contact 20 is made of an electrically conductive metal and includes threaded female fittings (not shown) opening vertically axially through either end Mounted on the outer surface of circuit contact 20 are eight roller elements 60 that protrude from the outer surface of circuit contact 20 sufficient to provide roller clearance between the cylindrical body and the inner surface of tubing 16 (FIG. 2). Roller elements 60 are mounted in eight rectangular mounting apertures or slots 62. Roller elements 60 are made of a relatively soft electrically conductive metal. This soft metal permits roller elements 60 to wear to a configuration that provides a smooth rolling abutment with tubing 16. Roller elements 60 are each mounted on a smooth electrically conductive axle 64 that permits a current applied to the body of circuit contact 20 to pass through roller elements 60 to tubing 16. Preferably each axle 64 is a hardened shoulder screw that extends into the body of circuit contact 20 on either side of mounting aperture 62 in order to provide a rigid bearing surface for roller elements 60.

Figure 4:
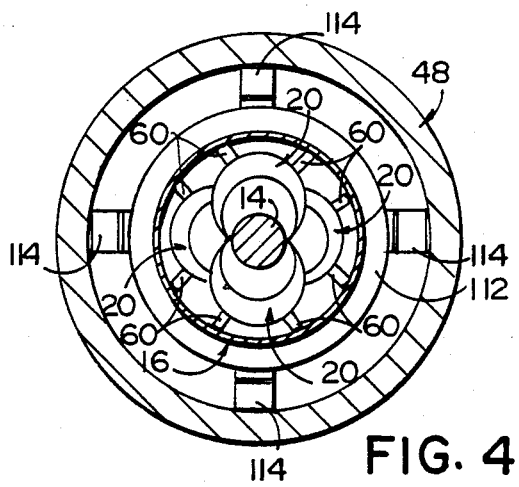
FIG. 4 is a sectional plan view of the oil well taken along plane IV—IV of FIG. 1.

Roller elements 60 are grouped into two sets of four roller elements 60, with the roller elements 60 of each set being spaced equally about the perimeter of circuit contact 20. The two sets of roller elements 60 are also vertically aligned. The spacing of the roller elements 60 at ninety degree angles about the perimeter of contact 20 permits two roller elements 60 of each set to simultaneously contact tubings 16 as shown in FIG. 4, so that a total of four roller elements from each circuit contact 20 simultaneously contact tubing 16.

A one hundred eighty degree offset coupling 70 (FIG. 2) couples two vertically adjacent electrical circuit contacts 20. Coupling 70 has an upper leg 72 and a lower leg 74 joined by an angled offset region 76. Legs 72 and 74 each terminate in a threaded male fitting, and coupling 70 is formed from an electrically conductive metal. Preferably angled offset region 76 of coupling 70 provides an offset between the upper and lower fittings of coupling 70 sufficient to abut the vertically adjacent electrical circuit contacts 20 against diametrically opposed areas of tubing 16. Most preferably in an oil well having a tubing string 16 with an inside diameter of 1.947 inches, coupling 70 offsets the vertically adjacent electrical circuit contacts 20 approximately 0.11 inches. Each electrical circuit 20 is therefore offset approximately 0.055 inches from the center axis of tubing 16 and sucker rod 14.

A ninety degree offset coupling 80 (FIG. 2) also couples two vertically adjacent electrical circuit contacts 20. Offset coupling 80 similarly includes an upper leg 82 and a lower leg 84 joined by an angled offset region 86. Coupling 80 has threaded male fittings on either end that mate with the fittings on circuit contacts 20. Offset coupling 80 is provided with an angled offset region 86 that is configured to offset the vertically adjacent circuit contacts 20 from the center line of tubing string 16, but to offset contacts 20 along radii spaced approximately ninety degrees about the circumference of the tubing 16. Preferably, in an oil well having a tubing string with an inside diameter of 1.947 inches, coupling 80 has an angled offset region 86 configured to offset each circuit contact 20 approximately 0.055 inches from the center axis of tubing 16.

Figure 5:
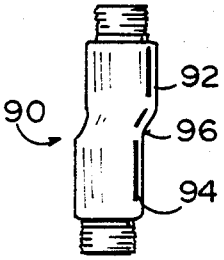
FIG. 5 is an elevational view of an electrical circuit contact coupling used in the system of FIG. 1.
Figure 6:
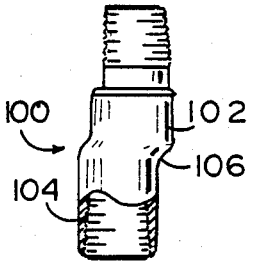
FIG. 6 is a sectional, elevational view of another electrical circuit contact coupling used in the system of FIG. 1.

Shown in FIG. 5 is a top offset coupling 90. Offset coupling 90 has an upper leg 92, a lower leg 94 and an angled offset region 96. Either end of coupling 90 terminates in threaded male fittings. Top offset coupling 90 is secured to the lower end of a section of sucker rod 14 and to the upper end of one circuit contact 20. Top offset coupling 90 is configured similarly to on hundred eighty degree offset coupling 70, with the exception that top offset coupling 90 has an angled offset region that offsets legs 92 and 94 half the distance of the spacing provided by coupling 70. This half-distance offset is due to the center line position of sucker rod 14 at the center line of tubing 16. Most preferably, in an oil well having a tubing string 16 with an inside diameter of 1.947 inches, top offset coupling 90 offsets circuit contact 20 approximately 0.55 inches from the central axis of tubing string 16 and sucker rod 14. A lower offset coupling 100 is shown in FIG. 6. Lower offset coupling 100 is similar to top offset coupling 90, and has an upper leg 102, lower leg 104 and angled offset region 106. The end of upper leg 102 terminates in a threaded male fitting that mates with the bottom of one electrical circuit contact 20. Lower leg 104 has a threaded female fitting that mates with the fitting on the upper end of a section of sucker rod 14 (not shown). Angled offset region 106 provides an offset equal to that of top offset coupling 90.

In one preferred embodiment, four electrical circuit contacts 20 are coupled in sucker rod 14 using one top offset coupling 90, one lower offset coupling 100, one ninety degree offset coupling 80 and two one hundred eighty degree offset couplings 70. The electrical circuit contacts 20 are grouped into two pairs. The two electrical circuit contacts 20 of each pair are forced against diametrically opposed regions of tubing string 16 by use of one hundred eighty degree offset couplings 70. The two sets of electrical circuit contacts are joined by the ninety degree offset coupling 80, resulting in electrical circuit contacts 20 being spaced radially outwardly from the central axis of sucker rod 14 and against the inner surface of tubing 16 in four directions as shown in FIG. 4. The interconnected electrical circuit contacts 20 are connected to adjacent sucker rod sections using top offset coupling 90 and lower offset coupling 100.

Alternatively, ninety degree offset couplings 80 are used between all vertically adjacent electrical circuit contacts 20. In this embodiment, electrical circuit contacts 20 are stepped about the inner surface of tubing 16 in ninety degree steps. In either of the above alternative embodiments, the offsetting of electrical circuit contacts 20 creates a spring-like force that holds contacts 20 in tight abutment with the inner surface of tubing string 16.

Figure 7:
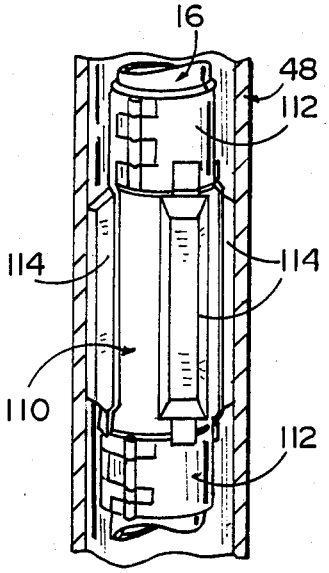
FIG. 7 is a fragmentary, sectional view of an oil well tubing-casing insulator used in the system of FIG. 1.

A tubing insulator 110 is shown in FIG. 7. Each tubing insulator 110 includes a pair of vertically spaced clamping collars 112 that are hinged and provided with a conventional clamping mechanism. A set of four elongated rectangular insulative pads 114 are spaced about the perimeter of clamping collars 112. Pads 114 are formed from an electrically insulative material and extend between clamping collars 112. Tubing insulators 110 are clamped along the upper region of tubing 116. Tubing insulators 110 are preferably spaced at intervals sufficient to prevent contact between tubing 16 and casing 48, and most preferably at approximately thirty foot intervals. Tubing insulators 110 prevent a short from occurring between tubing 116 and casing 48.

Figure 8:
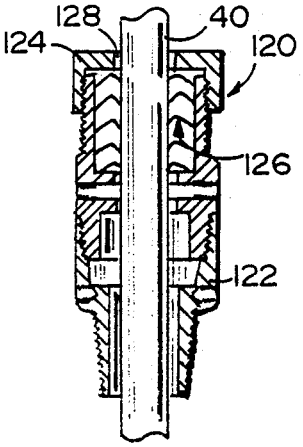
FIG. 8 is a fragmentary, sectional view of the stuffing box region of the oil well shown in FIG. 1, taken in region of Arrow VIII.

Polish rod 40 is insulated from shorting with tubing 16 at a stuffing box 120 (FIG. 8) at the upper end of a pumping tee 122 on tubing 16. Stuffing box 120 includes a top cap 124 that clamps a set of flexible seals 126 about polished rod 40. Seals 126 are made from an electrically insulative material such as nylon or the like. The seals 126 insulate and center the sucker rod 14 with respect to the tubing 16 in the vicinity of the stuffing box 120. The upper aperture 128 through top cap 124 provides sufficient clearance that polished rod 40 does not contact top cap 124. Alternatively, top cap 124 is also made from an electrically nonconductive material in order to prevent arcing from occurring between polished rod 40 and top cap 124.

Insulating material is also provided between tubing 16 and a casing head 130 located at the top of casing 48 (FIG. 1). This insulated material (not shown) may preferably be a nonconductive sleeve that is fitted between tubing 16 and casing head 130 prior to clamping casing head 130 into place. An insulative top housing 132 (FIG. 1) is positioned over the top of casing head 130, stuffing box 120 and pumping tee 122 in order to prevent accidental contact with the electrified components by operators. A short section of electrically nonconductive flow line 134 is also connected to the pumping tee 122 to thereby insulate the remaining flow line from any current. Alternatively, pumping tee 122 is formed from an electrically insulative material to prevent a short from occurring at tubing 16 and to prevent flow line 134 from becoming electrified.

Power source 18 is a low voltage transformer and the current may be rectified. Transformer 18 is preferably removably connected to a circuit box 140. A pair of electrical leads 142 and 144 extend from circuit box 140 to the oil well. Cable 142 is secured to polished rod 40 while cable 144 is secured to tubing 16 above casing head 130. Power source 18 may be mounted on a vehicle so that a single transformer 18 and rectifier may be used to service a number of different oil wells. Suitable controls 150 are provided for transformer 18 and rectifier, while a conventional timer circuit 152 is included with controls 150.

Timer circuit 152 is used to periodically shut down the operation of pumping unit 12, since oil well pumping units 12 conventionally operate for only a predetermined period of time in order to permit the oil source to replenish. Timer circuit 152 includes a suitable sensor and switch 153 associated with pumping arm 34. Pumping arm sensor 153 detects when pumping arm 34 is in a raised position and the associated switch prevents timer circuit 152 from halting pumping unit 12 other than in such a raised position. It is believed that in this raised position the weight of the oil bearing down on sucker rod pump 44 will cause electronic circuit contacts 20 to be forced into tight abutment with tubing 16. Timer circuit 152 also switches power from drive motor 30 to transformer 18 in order to operate system 10 with the operating power available at the pumping site.

Transformer 18 preferably has an output below eighty volts and less than three hundred seventy amps, although these figures will depend o the depth of the well and depth of paraffin accumulation. This low voltage reduces the chances of injury to persons accidentally contacting the electrified components. Alternatively the voltage may range somewhat lower than the eighty volts while still providing for operator safety. The current will correspondingly range somewhat lower than three hundred seventy amps. In a typical oil well having a sucker rod diameter of 0.625 inches and tubing with a 1.947 inch inside diameter and 2.375 inch outside diameter, the application of such an electrical current to the sucker rod will result in approximately five-sixths of the heat generated by the system to be generated by the sucker rod, while roughly one-sixth of the heat generated is that produced by the tubing. Since the majority of the heat generated emanates from the sucker rod immersed in the surrounding oil, a higher percentage of the heat generated operates on the surrounding oil and paraffin prior to being conducted outwardly from the oil well.

It is estimated that a two hour run of the paraffin removal system 10 on a daily basis would prevent the accumulation of sufficient paraffin and appreciably increase the oil well output. In those walls where paraffin accumulation is subnormal, it may only be necessary to run the system over cycles on one or more weeks. Preferably the paraffin removal system 10 is run during periods that pumping unit 12 is shut down. The power used to run pumping unit 12 is then available to transformer 18 for use with system 10.

An alternative preferred embodiment incorporated into FIG. 1 provides regions or sections of higher resistance material in the production string in order to increase the amount of heat generated in that region. A section 156 of pump 44 has an increased electrical resistance, and most preferably is 18–8 stainless steel material. Such stainless steel material has an electrical resistivity approximately five times that of conventional materials used in production strings. The upper end of increased resistance section 156 is cut into a threaded male fitting (not shown) while the lower end is formed into a threaded female socket (not shown). Increased resistance section 156 is therefore threaded into the remainder of pump 44 in the same manner as sections of sucker rod 14 are coupled together. Alternatively, the entire pump 44 may be made of a material having a higher electrical resistance, such as stainless steel, or various individual sections of sucker rod 14 may be made of such a higher electrical resistance material.

In use, regions of the oil well that have a accumulation of paraffin are first determined, such as by logging the well or the like. The elements of the production string in the vicinity of such high paraffin accumulation are replaced with elements made of a material having a higher electrical resistance. Since sucker rod 14 and pump 44 reciprocate vertically, in one preferred form the elements having an increased resistance are located to extend both above and below the region of high paraffin accumulation. Alternatively, in another preferred form, the elements having a higher electrical resistance are located at the lower end or beneath the region or regions of high paraffin accumulation. In this embodiment due to the chimney effect produced within the well, with heat convecting upwardly, the region above the higher resistance element will be heated.

When sections of the production string are made from a higher electrical resistance material, the voltage of transformer 18 is increased slightly. Preferably the voltage of transformer 18 remains sufficiently low to reduce the chance of injury to persons that may accidentally contact the electrified components. It is also believed that regions of high paraffin accumulation will be located at cold spots within the well, such as in the vicinity of underground streams or the like. It is therefore believed that positioning of the higher resistance components at or below these cold regions will effectively reduce paraffin accumulation within the well.

Figure 9:
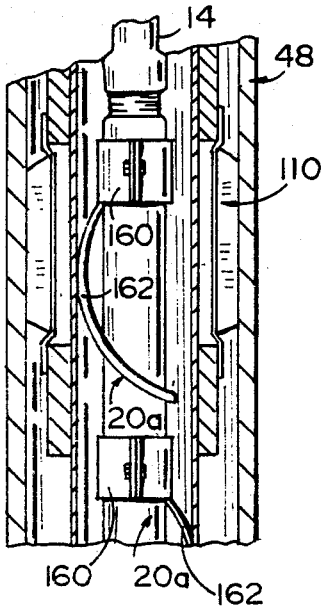
FIG. 9 is a fragmentary, sectional view of an alternative electrical circuit contact used in an alternative embodiment of the invention shown in use.
Figure 10:
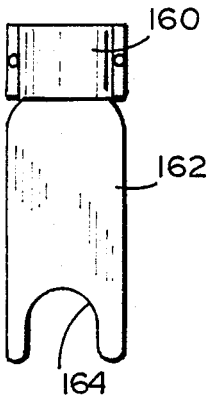
FIG. 10 is a side elevational view of the alternative electrical circuit contact shown in FIG. 9.

Another alternative preferred embodiment is shown in FIGS. 9 and 10. The alternative embodiment of FIGS. 9 and 10 is the same as that of system 10 described above, with the exception of the below noted components. The alternative embodiment therefore includes sucker rod 14 that depends in tubing string 16. Tubing 16 is spaced from casing 48 by tubing insulators 110. A pair of alternative electrical circuit contacts **20*a* close the electrical circuit between sucker rod 14 and the inner surface of tubing 16. Each electrical circuit contact 20*a* includes an upper clamping collar 160. A curved leaf spring contact 162 depends from collar 160. A notch 164 (FIG. 10) is formed in the lower edge of leaf spring 162. Notch 164 seats sucker rod 14 but permits the bowed section of leaf spring 162 to slide along sucker rod 14. Electrical circuit contacts 20*a* flex and thereby provide a sliding contact between sucker rod 14 and tubing 16. In another embodiment, sucker rod pump 44 is made from an electrically conductive material and is dimensioned so as to provide sufficient contact with tubing 16 to form a closed circuit between sucker rod 14 and tubing 16. In still another embodiment, transformer 18 is connected to sucker rod 14 and the ground so that sucker rod 16 with electrical circuit contacts 20*a* grounds out through the lower end of tubing 16**.

Figure 11:
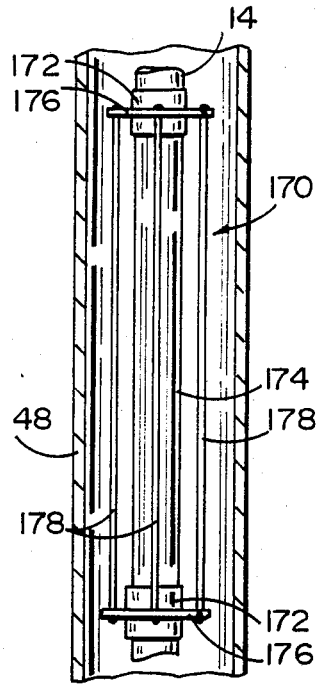
FIG. 11 is a fragmentary, sectional view of an alternative electrical circuit contact incorporating a heat concentrating element used in an alternative embodiment of the invention shown installed in a condition for use.

Another alternative preferred embodiment is shown in FIG. 11. The alternative embodiment of FIG. 11 may be used in conjunction with any of the embodiments noted above. The alternative embodiment of FIG. 11 incorporates a heat concentrating element 170 into the production string about sucker rod 14. Heat concentrating element 170 includes a coupling 172 which is threaded to couple with sucker rod sections above and below the concentrating element 170. A spacer section 174 of sucker rod extends between couplings 172. Spacer section 174 is made from a nonconductive material, such as fiberglass. A disc shaped mounting flange 176 is welded or otherwise joined to each coupling 172, and a series of relatively thin, elongated heating elements 178 extend between mounting flanges 176. Couplings 172, mounting flanges 176 and heating elements 178 are all made of a conductive metal in order to conduct electricity between the sucker rod sections immediately above and below spacer section 174. Heater elements 178 may be resistance heating elements, electrically conductive cables, thin rods, resistance wire or the like. As shown in FIG. 11, four heating elements 178 extend between mounting flanges 176, although a greater or lesser number may be utilized as required.

Heat concentrating element 170 is located in the production string, to reciprocate in a region of high paraffin buildup, or in the oil producing zone, to melt the paraffin from within the rock. Heat concentrating element 170 may be located in sucker rod 14 with a closed circuit being formed between sucker rod 14 and casing 48 as described above. Due to the narrow cross section of heating elements 178 relative to the cross-sectional area of sucker rod 14, heating elements 178 increase the heat radiated or conducted to the surrounding area as compared to that provided by a large diameter sucker rod. Alternatively, heating elements 178 may be made of a material having an increased electrical resistance, such as stainless steel.

Figure 12:
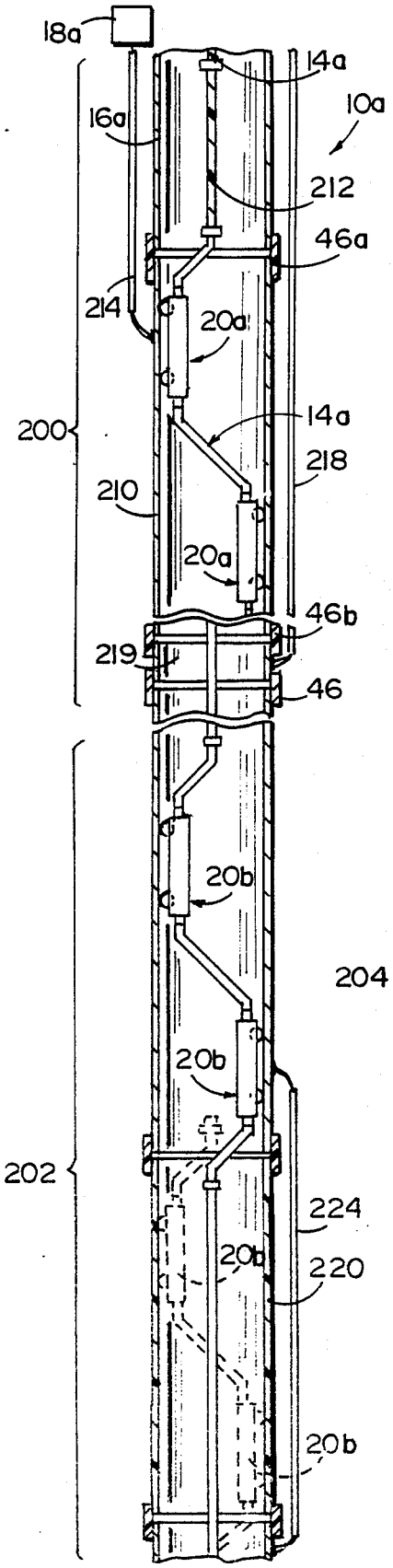
FIG. 12 is a fragmentary, sectional view of an still another alternative embodiment of the paraffin removal system, taken at an upper region and an intermediate region of the oil well, and shown with the sucker rod in a raised position.
Figure 13:
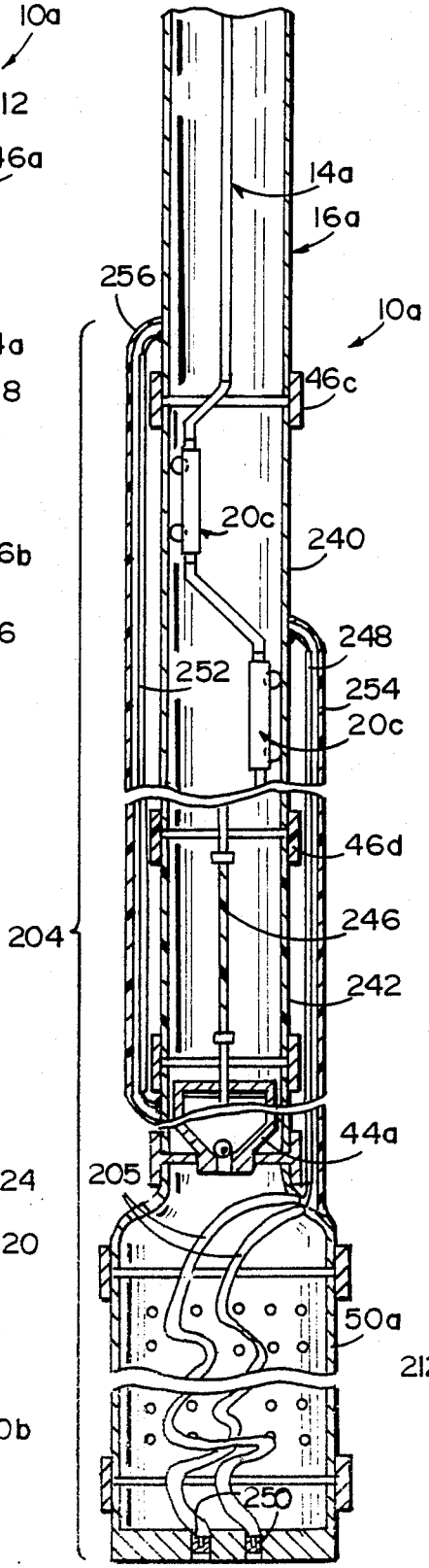
FIG. 13 is a fragmentary, sectional view of the alternative embodiment of FIG. 12, taken at a lower region of the oil well, and shown with the sucker rod in a lowered position.
Figure 14:
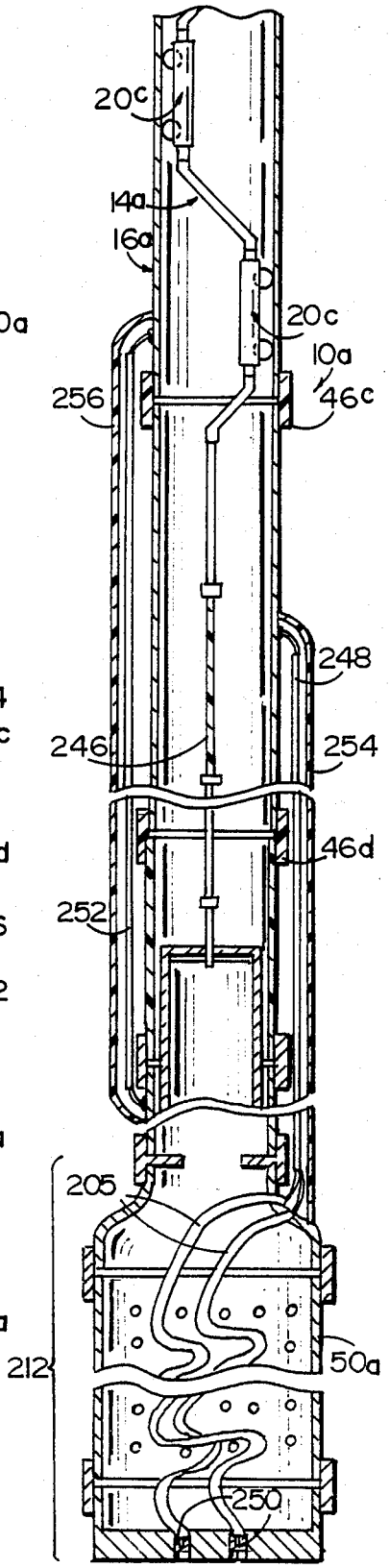
FIG. 14 is a fragmentary, sectional view of the alternative embodiment of FIG. 13, shown with the sucker rod in a raised position.

Still another preferred embodiment of the system for removing accumulated paraffin from an oil well, designated generally by the numeral 10*a*, is shown in FIGS. 12–14. The embodiment of 10*a* may be used in conjunction with the embodiments noted above in FIGS. 1–11. As will be recognized, system 10*a* for removing accumulated paraffin from an oil well is constructed and operates in a fashion which is similar in many respects to previously described paraffin removing system 10. Therefore, common elements of paraffin removing system 10*a* are given reference numerals similar to the reference numerals of accumulated paraffin removing system 10, with the exception of the addition of suffixes, such as "a".

As shown in FIGS. 12–14 paraffin removing system 10*a* encompasses three circuit assemblies in distinct region of the oil well, an upper circuit assembly 200 (FIG. 12) in an upper region or zone of the well, a middle or intermediate circuit assembly 202 (FIG. 12) in a middle or intermediate region or zone which is may be located 500 to 600 feet below the surface, or alternatively is located beneath a region of particularly high paraffin accumulation, and a lower heater circuit assembly 204 (FIG. 13) that is located in a region or zone toward the bottom of tubing string 16*a*. Upper circuit assembly 200 is used to transmit electric current or energy into sucker rod 14*a* in order to be conducted down into the well, as well as to insulate the above ground apparatus from the paraffin melting current. Intermediate circuit assembly 202 is an optional circuit which may be employed in certain instances to selectively concentrate the paraffin melting current in in the region or zone of the production string extending above intermediate circuit assembly 202, as Well as to isolate tubing string 16*a* into two separate heating regions that are heated alternatingly as discussed below. Lower heater circuit assembly 204 operates to selectively couple a heater element 205 at the base of the oil well into the heater circuit with sucker rod 14*a* and tubing string 16*a*. Lower heater circuit assembly 204 may also be alternatingly switched on and off to permit selected regions of the oil well to be alternatingly heated.

Upper circuit assembly 200 includes a section of electrically conductive tubing 210 (FIG. 12) that is contacted by upper electrical circuit contacts 20*a*. Although only two upper circuit contacts 20*a* are shown, a set of four radially offset upper circuit contacts 20*a* of the type discussed above are most preferable. Upper circuit contacts 20*a* roll or reciprocate up and down along electrically conductive tubing 210 as sucker rod 14*a* reciprocates. Conductive tubing 210 is sufficiently long that upper circuit contacts 20*a* will not roll either above or below conductive tubing 210 as sucker rod string 14*a* reciprocates. Conductive tubing 210 is coupled into tubing string 16*a* by an upper insulative coupling 46*a* and a lower insulative coupling 46*b*. Insulative couplings 46*a* and 46*b* are made of fiberglass or other electrically nonconductive material in order to electrically isolate conductive tubing section 210 from the remainder of tubing string 16*a*. An insulated sucker rod section 212 is made of fiberglass or other electrically nonconductive material in order to electrically insulate the polished rod and other above ground elements from the paraffin melting current.

An electrical lead 214 is welded or otherwise coupled to conductive tubing section 210, and is also coupled to an appropriate power source 18*a*. Electrical lead 214 is the "hot" lead, while a ground lead 218 is welded or otherwise coupled to tubing string 16*a* beneath lower insulated coupling 46*b*. Lower insulated coupling 46*b* therefore separates the "hot" electrical lead 214 from ground lead 218, thus causing current to run through sucker rod 14*a* down into the oil well and then be grounded back out through tubing string 16*a* and ground lead 218.

As noted above, ground lead 218 may be welded to the exterior of a tubing section of tubing string 16*a*. Alternatively, ground lead 218 may be welded to a short ground coupling tubing section 219. Ground coupling tubing section 219 is then coupled into tubing string 16*a* by lower insulated coupling 46*b* and a conventional metal coupling 46. With ground coupling tubing section 219, ground lead 218 may be welded away from the oil well site and then quickly installed during a workover by coupling into tubing string 16*a*.

As shown in FIG. 12, intermediate circuit assembly 202 is located beneath the ground surface and beneath a zone of the oil well that is desired to be separately heated. For example, intermediate region 202 may be located beneath a cold region of the oil well, at which cold region it is thought that a high accumulation of paraffin may occur. Intermediate circuit assembly 202 operates to selectively concentrate the paraffin melting current in the region above intermediate circuit assembly 202 during a certain phase of the pumping cycle. Therefore, if the entire length of sucker rod string 14*a* is intended to be heated intermediate circuit assembly 202 would not normally be employed.

Intermediate circuit assembly 202 includes an electrically insulative tubing section 220 (FIG. 12) coupled into tubing string 16*a*. Insulative tubing section 220 is made of fiberglass or other nonconductive material in order to break the electrical conductivity of tubing string 16*a*. As shown in FIG. 12, a set of intermediate electrical circuit contacts 20*b* are located above insulative tubing section 220 when sucker rod 14*a* is in the raised or "up" position. Again, although only two intermediate circuit contacts 20*b* have depicted, most preferably a set of four intermediate circuit contacts are radially arranged as described above. In this raised position, intermediate circuit contacts 20*b* contact the electrically conductive section of tubing string 16*a* located above insulative tubing section 220. In the raised position intermediate circuit contacts 20*b* therefore form a closed circuit or short circuit between sucker rod 14*a* and tubing section 16*a* at this zone, causing the current running through sucker rod 14*a* to short back up through tubing 16*a* to ground lead 218. Thus, when sucker rod 14*a* is in the raised position, although a very minimal amount of current may run down through sucker rod 14 beneath insulative tubing section 220, substantially all of the current and heating occurs in sucker rod string 14*a* and tubing string 16*a* above insulative tubing section 220.

Electrically insulative tubing section 220 is long enough vertically to accommodate intermediate circuit contacts 20b when sucker rod 14 is in the lowered or down position (FIG. 12, shown in phantom). A jumper or bridging cable 224 is welded or coupled to the exterior of tubing string 16a both above and below electrically insulative tubing section 220. Cable 224 forms an electrical bridge or circuit bypassing insulative tubing section 220, thus allowing current to travel from lower heater circuit assembly 204 up through tubing string 16a to ground lead 218. When sucker rod 14a is in the lowered position, intermediate circuit contacts 20b contact insulative tubing section 220 and therefore no short circuit or closed circuit is formed between sucker rod 14a and tubing string 16a at this point. A substantial amount of the paraffin melting current is therefore conducted down through sucker rod 14a to the region beneath insulative tubing section 220.

Alternatively, electrically insulative tubing section 220 may be formed of an electrically conductive metal having an insulative sleeve or coating, such as fiberglass, on the inner surface. In this alternative embodiment, the insulative inner sleeve or coating prevents a short circuit from forming between intermediate circuit contacts 20b and tubing string 16a at this point. Nonetheless, the electrically conductive exterior of alternative insulative tubing section 220 allows current to pass back up through tubing string 16a. In this alternative embodiment jumper or bridging cable 224 is not required.

As noted above, lower heater circuit assembly region 204 may be used either with or without intermediate circuit assembly 202. Lower heater circuit assembly 204 most preferably encompasses the lower fifty five feet of the well, and includes a pair of bottom heater coils 205 (FIGS. 13–14) at the base of the well. Heater coils 205 are coiled about the inner surface of perforated bottom nipple 50a in order to be positioned beneath sucker rod pump 44a. When bottom heater coils 205 are used in a system that includes intermediate circuit assembly 202, the paraffin melting current is alternated between the region above insulative tubing section 220 and the entire production string including bottom heater coils 205. When bottom heater coils 230 are used in a system that does not incorporate intermediate circuit assembly 202, the paraffin melting current is alternated between the region of sucker rod string 14a and tubing string 16a above bottom heater coils 205, and the entire production string including bottom heater coils 205.

As shown in FIG. 13, sucker rod 14a is in a lowered position. Toward the lower end of the production string is located an electrically conductive tubing section 240. Conductive tubing section 240 is electrically isolated from the remainder of tubing string 16a by an upper insulative coupling 46c and a lower insulative coupling 46d made out of fiberglass o other suitable electrically insulative material. A lower set of electrical contacts 20c inadvertently contact electrically conductive tubing section 240 when sucker rod string 14a is in a lowered condition. An insulative tubing section 242 may be coupled beneath conductive tubing section 240 in order to insure that elements beneath conductive tubing section 240 are not electrified in the event that lower circuit contacts 20c roll down beneath conductive tubing section 240. An insulative sucker rod section 246 is coupled in sucker rod string 14a beneath lower circuit contacts 20c. Insulative sucker rod section 246 operates to electrically insulate pump 44a and the remainder of sucker rod string 14a from the paraffin melting current.

A jumper or bridging cable 248 is welded or otherwise connected to the exterior of conductive tubing section 240 and to bottom heater coils 205. The lower ends 250 of bottom heater coils 205 are connected to perforated bottom nipple 50a to form a pair of electrical leads. When sucker rod string 14a is in the lowered position, current is conducted down through sucker rod string 14a to conductive tubing section 240 and then down through bridging cable 248 to bottom heater coils 205.

A grounding jumper or bridging cable 252 (FIGS. 13–14) is connected to an electrically conductive tubing section beneath insulative tubing section 242. Grounding bridging cable 252 is also coupled to an electrically conductive tubing section above upper insulative coupling 46c. Current is therefore conducted from perforated bottom nipple 50a up through grounding bridging cable 252 and up to the remainder of tubing string 16a above upper insulative coupling 46c. When sucker rod string 14a is in the lowered position (FIG. 13), paraffin melting current runs through lower circuit contacts 20c to conductive tubing section 240, down through bridging cable 248 to bottom heater coils 205, back up through perforated bottom nipple 50a, up through grounding bridging cable 252 and up through tubing string 16a to ground lead 218. When sucker rod string 14a is in the raised position shown in FIG. 14, lower circuit contacts 20c will form a closed circuit or short circuit between sucker rod string 14a and tubing string 16a above upper insulative coupling 46c. Paraffin melting current will therefore be conducted down through sucker rod string 14a, through lower circuit contacts 20c and back up through tubing string 16a to ground lead 218. With sucker rod string 14a in the raised position, bottom heater coils 205 are electrically isolated from the paraffin melting current by upper insulative couplings 46c and insulative sucker rod section 246, and are therefore "switched off".

A pair of protective fiberglass sheaths 254 and 256 may be mounted on the exterior of tubing string 16a in order to surround bridging cable 248 and grounding bridging cable 252, respectively. Protective sheaths 254 and 256 prevent bridging cable 248 and grounding bridging 252 from being severed or otherwise broken off from tubing string 16a as tubing string 16a is being lowered down into the well. Protective sheathing may similarly be used to protect intermediate bridging cable 224, as well as electrical lead 214 and ground lead 218.

Power source 18a provides two separate modes. In a low voltage operating mode power source 18a generates one less than eighty volts at slightly less than three hundred amperes. This low voltage operating mode may alternatively provide a voltage as low as approximately fifty volts with somewhat lower amperes. In a high voltage operating mode, power source 18a generates somewhat higher voltage at slightly less than one hundred amperes. This high voltage operating mode may alternatively provide a voltage of approximately two hundred volts. Power source 18a may include two separate transformers to produce this change in current, or a variable transformer may be employed. With a two mode power source 18a, if desired, the level voltage and current may be alternated as sucker rod 14a is reciprocated up and down in order to apply a different voltage when sucker rod 14a is in the raised position as opposed to the voltage that is applied when sucker rod 14a is in the lower position.

Most preferably bottom heater coils 205 have an electrical resistance of 1.7 ohms. The electrical resistance of heater coils 205 is in the range of three times as great as the electrical resistance of sucker rod string 14a and tubing string 16a. With heater coils 205 having this increased resistance, when sucker rod string 14a in the lowered position in order to "switch on" bottom heater coils 205 it is believed that three quarters of the electric energy conducted down into the well will generate heat in bottom heater coils 205. When sucker rod string 14ais in the raised position and bottom heater coils 205 are "switched off", all of the heat generated is that due to current through sucker rod string 14a and tubing string 16a. In order to increase the efficiency of paraffin removal system 10a, power source 18a includes a control circuit 150 and a timer circuit 152, which switch power source 18a into the high voltage operating mode when sucker rod string 14a is in the lowered position and bottom heater coils 205 are "switched on". Control circuit 150a and timer circuit 152a switch power source 18a into the low voltage operating mode when sucker rod string 14a is in the raised position and bottom heater coils 205 are "switched off". Alternatively, power source 18a may provide current at a single voltage and amperage throughout the reciprocation cycle of sucker rod string 14a.

It is to be understood that the above is a description of the preferred embodiments and that one skilled in the art will recognize that various modifications or improvements may be made without departing from the spirit of the invention disclosed herein The scope of protection afforded is to be determined by the claims which follow and the breath of interpretation that the law allows.

The embodiments of the invention in which an exclusive property or privilege is claimed are as follows:

1. An apparatus for use in an oil well having a tubing and a reciprocating sucker rod in order to reduce the accumulation of paraffin in said tubing by the application of an electric current to said sucker rod, said sucker rod having a central vertical axis, comprising:

a plurality of offset sucker rod sections, each said offset sucker rod section having at least one roller element thereon adapted to roll along the inner surface of said tubing, said offset sucker rod sections and said roller elements being electrically conductive and each said offset sucker rod section having a central vertical axis; and a plurality of offset coupling elements, said offset coupling elements adapted to be coupled to said sucker rod and adapted to be coupled to said offset sucker rod sections such that said offset sucker rod sections are vertically spaced and coupled by said offset coupling element, said offset coupling elements configured to offset said central vertical axis of said offset sucker rod sections from said central vertical axis of said sucker rod, and said offset coupling elements adapted to abut said roller elements with the inside surface of said tubing when said offset sucker rod sections are coupled to said sucker rod and lowered into said tubing, said offset coupling elements being electrically conductive, whereby said offset sucker rod sections each comprise a length of said sucker rod and form an electrical contact between said sucker rod and said tubing.

2. The apparatus of claim 1, further comprising:

at least one section of said sucker rod being made of a material having a greater electrical resistance than that of the material of a majority of said sucker rod.

3. The apparatus of claim 2, wherein:

said one section of said sucker rod is made of stainless steel.

4. An apparatus for use in an oil well having a tubing and a reciprocating sucker rod in order to reduce the accumulation of paraffin in said tubing by the application of an electric current to said sucker rod, said sucker rod having a central vertical axis, comprising:

a rolling electric circuit contact element, said rolling electric circuit contact element having at least one roller element thereon adapted to roll along the inner surface of said tubing, said rolling electric circuit contact element and said roller element being electrically conductive, and said rolling electric circuit contact element having a central vertical axis; and an upper offset coupling element and a lower offset coupling element, said offset coupling elements each adapted to be coupled to said sucker rod and each adapted to be coupled to said rolling electric circuit contact element, said offset coupling elements configured to offset said central vertical axis of said rolling electric circuit contact element from said central vertical axis of said sucker rod, and said offset coupling elements adapted to abut said roller element with the inside surface of said tubing when said rolling electric circuit contact element is coupled to said sucker rod and lowered into said tubing, said offset coupling elements being electrically conductive;

said tubing including an electrically insulative tubing section having an electrically insulated inner surface disposed to be selectively contacted by said rolling circuit contact element as said sucker rod vertically reciprocates;

means for conducting electricity from a section of the tubing disposed below said insulative tubing section to a section of the tubing disposed above said insulative tubing section.

5. The apparatus of claim 4, wherein:

said tubing has a pump region whereat a sucker rod pump apparatus is disposed;

a separate heater element disposed generally beneath said pump region.

6. A method of reducing the accumulation of paraffin in an oil well having production tubing and a sucker rod that reciprocates therein, comprising:

forming an electrical circuit contact between said sucker rod and said tubing;

providing an electric power source;

connecting said electric power source to said sucker rod and said tubing;

electrically insulating an upper region of said sucker rod from a lower region of said sucker rod;

intermittently applying an electric current to said sucker rod over a time period sufficient to generate heat in said sucker rod and melt accumulated paraffin within said tubing, said electric current applying step including alternating the application of current between applying an electrical current to one of said sucker rod upper region and lower region and applying an electrical current to both said sucker rod upper region and lower region.

7. A method of reducing the accumulation of paraffin in an oil well having production tubing and a sucker rod that reciprocates therein, comprising:

forming an electrical circuit contact between said sucker rod and said tubing;

providing an electric power source;

connecting said electric power source to said sucker rod and said tubing;

electrically insulating an upper region of said sucker rod from a lower region of said sucker rod;

stopping the reciprocation of said sucker rod on an upstroke, and applying an electric current to said sucker rod while said sucker rod is stopped for a time sufficient to generate heat in said sucker rod and melt accumulated paraffin within said tubing, said electric current applying step including alternating the application of current between applying an electrical current to one of said sucker rod upper region and lower region and applying an electrical current to both said sucker rod upper region and lower region.

8. A method for reducing the accumulation of paraffin in an oil well having production tubing and a sucker rod that reciprocates therein, comprising:

forming an electrical circuit contact between said sucker rod and said tubing;

providing an electrical power source;

connecting said electric power source to said sucker rod and said tubing;

electrically insulating an upper region of said sucker rod from a lower region of said sucker rod;

applying an electric current to said sucker rod for a time sufficient to generate heat in said sucker rod and melt accumulated paraffin within said tubing, said electric current applying step including applying an electric current at approximately fifty volts and three hundred seventy amperes, and said electric current applying step including alternating the application of current between applying an electrical current to one of said sucker rod upper region and lower region and applying an electrical current to both said sucker rod upper region and lower region.

9. A method of reducing the accumulation of paraffin in an oil well having production tubing and a sucker rod that reciprocates therein, comprising:

providing at least one preselected section of said sucker rod that is made of a material having an electrical resistance greater than the electrical resistance of the material of a majority of the remainder of said sucker rod;

forming an electrical circuit contact between said sucker rod and said tubing;

providing an electric power source;

connecting said electric power source to said sucker rod and said tubing;

electrically insulating an upper region of said sucker rod from a lower region of said sucker rod;

applying an electric current to said sucker rod for a time sufficient to generate heat in said sucker rod and melt accumulated paraffin within said tubing, said electric current applying step including alternating the application of current between applying an electrical current to one of said sucker rod upper region and lower region and applying an electrical current to both said sucker rod upper region and lower region.

10. A method of reducing the accumulation of paraffin in an oil well having production tubing and a sucker rod that reciprocates therein, comprising:

providing a sucker rod pump on said sucker rod, said sucker rod pump being made of a material having an electrical resistance greater than the electrical resistance of the material of a majority of said sucker rod;

forming an electrical circuit contact between said sucker rod pump and said tubing;

providing an electric power source;

connecting said electric power source to said sucker rod and said tubing;

electrically insulating an upper region of said sucker rod from a lower region of said sucker rod;

applying an electric current to said sucker rod for a time sufficient to generate heat in said sucker rod and melt accumulated paraffin within said tubing, said electric current applying step including alternating the application of current between applying an electrical current to one of said sucker rod upper region and lower region and applying an electrical current to both said sucker rod upper region and lower region.

11. An apparatus for use in reducing the accumulation of paraffin in an oil well having production tubing and a sucker rod that reciprocates therein, comprising:

an electrical contact element disposed on said sucker rod to form an electrical contact between said sucker rod and said tubing;

an electrically insulated sucker rod section disposed between an upper sucker rod region and a lower sucker rod region;

an electrical power supply selectively electrically coupled to said upper and lower sucker rod regions and said tubing so as to apply current and heat said sucker rod;

a switch mechanism defined by said sucker rod, said tubing and said electrical contact element for alternatively switching said electrical current to one of said sucker rod upper region and lower region and to both said sucker rod upper region and lower region in response to movement of said sucker rod relative to said tubing.

12. The apparatus of claim 11, wherein:

said apparatus includes a plurality of electrical contact elements;

said switch mechanism includes one of said electrical contact elements disposed to selectively contact said electrically insulated sucker rod section.

13. The apparatus of claim 12, wherein:

said electrical power supply is adapted to apply a first voltage when said current is applied to both said upper and lower sucker rod sections, and to apply a second voltage different from said first voltage when said current is applied to one of said upper and lower sucker rod sections.

14. An apparatus for reducing the accumulation of paraffin in an oil well having a production tubing and a sucker rod that reciprocates therein, comprising:

a circuit network comprising said production tubing, said sucker rod, a circuit contact element on said sucker rod and vertically movably contacting said production tubing so as to selectively electrically couple said sucker rod to said tubing, at least one lower heating element disposed beneath said circuit contact element toward a lower zone of said oil well and an electrically insulated region on said tubing above said at least one lower heating element;

an electric power source having a first voltage output coupled to said circuit network;

said circuit network forming a means for selectively applying electrical current to said at least one lower heating element by alternatively contacting the circuit contact element with the tubing and the electrically insulated region as the sucker rod vertically reciprocates within said tubing, whereby said one lower heating element is intermittently heated as said circuit contact element is vertically moved.

15. The apparatus of claim 14, wherein:

said heating element comprises a region of said sucker rod and said production tubing that is disposed generally beneath said circuit contact element.

16. The apparatus of claim 14, wherein:

said production tubing has a pump region whereat a sucker rod pump apparatus is disposed;

said heating element comprises a separate heating element disposed generally beneath said pump region.

* * * * *

UNITED STATES PATENT AND TRADEMARK OFFICE

CERTIFICATE OF CORRECTION

PATENT NO. : 4,911,239

DATED : March 27, 1990

INVENTOR(S) : Elmer Winckler and James W. McManus

It is certified that error appears in the above-identified patent and that said Letters Patent is hereby corrected as shown below:

Column 4, Line 20
After "end" insert --.--

Column 5, Line 20
"to on" should be --to one--

Column 7, Line 5
"o the" should be --on the--

Column 9, Line 27
"region" should be --regions--

Column 9, Line 44
"Well" should be --well--

Column 11, Line 55
"o other" should be --or other--

UNITED STATES PATENT AND TRADEMARK OFFICE

CERTIFICATE OF CORRECTION

PATENT NO. : 4,911,239

DATED : March 27, 1990

INVENTOR(S) : Elmer Winckler and James W. McManus

It is certified that error appears in the above-identified patent and that said Letters Patent is hereby corrected as shown below:

Column 13, Line 31
After "herein" insert --.--

Column 13, Claim 1, Line 55
"element" should be --elements-- (first occurrence)

Signed and Sealed this

Twenty-fifth Day of February, 1992

*Attest:*

*Attesting Officer*

HARRY F. MANBECK, JR.

*Commissioner of Patents and Trademarks*